US006441310B1

(12) United States Patent
Niedermier et al.

(10) Patent No.: US 6,441,310 B1
(45) Date of Patent: Aug. 27, 2002

(54) MOISTURE ACTIVATED BARRIER FOR ELECTRICAL ASSEMBLIES

(75) Inventors: Randall K. Niedermier, Akron; Dennis W. Lenk, Medina, both of OH (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/820,771

(22) Filed: Mar. 30, 2001

(51) Int. Cl.[7] ..... H01B 13/32

(52) U.S. Cl. ..... 174/137 A; 174/137 B; 174/138 C; 174/138 R; 174/140 C; 174/174; 174/178; 174/179; 174/195; 174/209; 174/211; 428/450

(58) Field of Search ..... 361/117; 174/178, 174/137 A, 137 B, 138 C, 138 R, 140 C, 174, 179, 195, 209, 211; 428/450, 457, 414, 425

(56) References Cited

U.S. PATENT DOCUMENTS

| | | | | |
|---|---|---|---|---|
| 3,585,278 A | 6/1971 | Quirk | 174/152 |
| 3,898,372 A | 8/1975 | Kalb | 174/179 |
| 4,125,742 A | 11/1978 | Rabinowitz | 174/211 |
| 4,217,466 A | 8/1980 | Kuhl | 174/209 |
| 4,223,366 A | 9/1980 | Sweetana, Jr. et al. | 361/127 |
| 4,476,155 A | 10/1984 | Niemi | 427/58 |
| 4,607,469 A | 8/1986 | Harrison | 52/220 |
| 4,830,688 A | 5/1989 | Staral | 156/48 |
| 4,991,053 A | 2/1991 | Cunningham | 361/117 |
| 5,043,838 A | 8/1991 | Sakich | 361/117 |
| 5,159,748 A | 11/1992 | Doone et al. | 29/613 |
| 5,206,780 A | 4/1993 | Varreng | 361/117 |
| 5,363,266 A | 11/1994 | Wiseman et al. | 361/127 |
| 5,402,100 A | 3/1995 | Urbanek et al. | 338/21 |
| 5,877,453 A | 3/1999 | Hill | 174/179 |
| 5,936,825 A | 8/1999 | DuPont | 361/127 |
| 6,008,975 A | 12/1999 | Kester et al. | 361/117 |

*Primary Examiner*—Chau N. Nguyen
*Assistant Examiner*—Jinhee J Lee
(74) *Attorney, Agent, or Firm*—Marcus R. Mickney; Mark S. Bicks; Alfred N. Goodman

(57) ABSTRACT

An assembly is provided having a core and a housing. The housing has an internal passageway extending from a first housing end to a second housing end for receiving the core. A coating of an uncured moisture activated material is disposed between the housing and the core. The coating cures upon reacting with moisture penetrating the housing to reseal the housing at a point of moisture penetration. The material cross-links in the presence of the moisture, thereby bonding with the moisture to prevent the moisture from contacting the core. The cured material is a rubber-like substance that adheres to the housing and to the core, thereby resealing the housing at the point of moisture penetration.

41 Claims, 2 Drawing Sheets

MOISTURE ACTIVATED BARRIER FOR ELECTRICAL ASSEMBLIES

FIELD OF THE INVENTION

The invention relates to a moisture activated barrier for an assembly. More particularly, the invention relates to a moisture activated barrier for composite insulators and surge arresters. The moisture activated barrier between the core and the housing of the assembly reacts with moisture that penetrates the housing to reseal the housing at the point of penetration.

BRIEF DESCRIPTION OF THE DRAWINGS

Electrical transmission lines are typically supported by insulators mounted on poles. Insulators are used to prevent the loss of electric charge or current from conductors in electric power transmission lines. Composite insulators are typically composed of polymer weathersheds (which form a housing), a fiberglass reinforced plastic rod, and metal end fittings secured to each end of the rod. The polymer weathersheds may be bonded to the rod or a silicone compound may be applied at the housing-rod interface. The rod-end fitting combination is the mechanical load member for the insulator. The polymer housing protects the rod from the environment in addition to providing electrical leakage distance. Generally, the weathersheds and the rod are made from different materials especially suited for the distinct functions of the two components. In general, the rod takes the mechanical load.

Composite insulators are prone to failure when the rod comes into contact with moisture. Moisture invasion may happen for many reasons, such as deterioration of the housing due to prolonged exposure to the weather, poor insulator design, and gunfire vandalism. Furthermore, the site of moisture penetration remains open allowing more moisture to enter the housing since there is no means to seal the site of moisture penetration.

Figure 1:
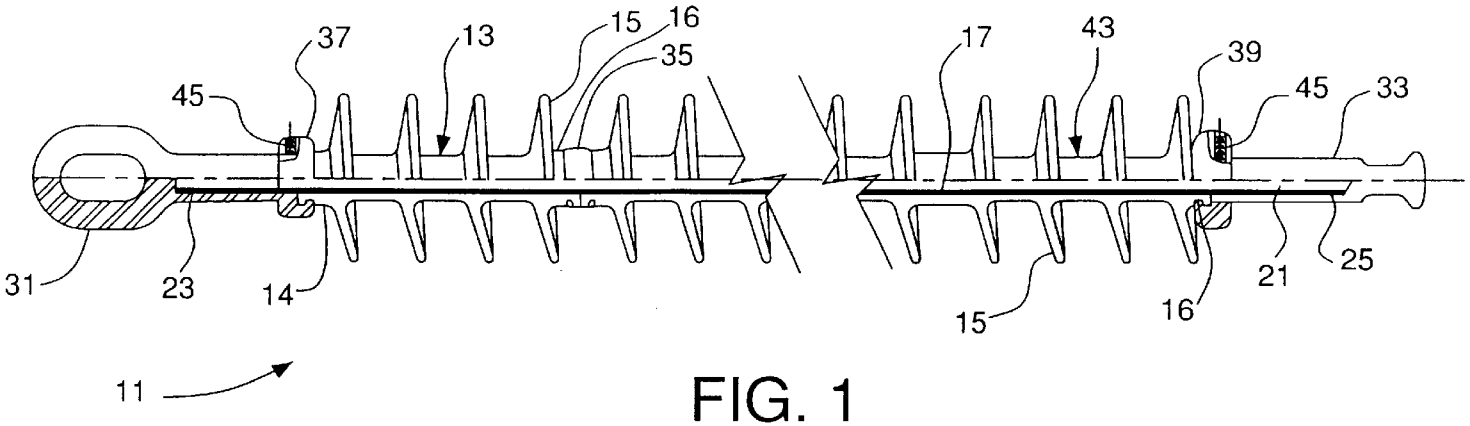

Examples of existing composite insulators are disclosed in the following references: U.S. Pat. No. 3,898,372 to Kalb; U.S. Pat. No. 4,656,555 to Raudabaugh; and U.S. Pat. No. 4,899,248 to Raudabaugh.

Surge arresters are commonly connected across a comparatively expensive piece of electrical equipment to shunt over-voltage surges. Such over-voltage surges occur, for example, when lightning strikes. When this happens, the surge arrester shunts the surge to ground, thereby protecting the piece of electrical equipment and the circuit from damage or destruction.

Surge arresters generally include an elongated, hollow cylindrical housing made of elastomeric material or the like, and a plurality of non-linear resistive blocks within the housing. The blocks commonly are metal oxide varistors (MOV), and are usually in the shape of relatively short cylinders stacked within the arrester housing. The number of blocks employed is a function of the material (MOV) and the voltage and current ratings of the assembly. For a surge arrester to function properly, the MOV blocks must be kept moisture free. Many existing surge arresters are susceptible to moisture invasion for many reasons, such as prolonged exposure to the weather, poor surge arrester design, and gunfire vandalism. Moreover, existing surge arresters have no means to prevent moisture that has entered the housing from contacting the MOV blocks. Furthermore, the site of moisture penetration remains open allowing more moisture to enter the housing since there is no means to seal the site of moisture penetration.

Examples of existing surge arresters are disclosed in the following references: U.S. Pat. No. 4,991,053 to Cunningham, U.S. Pat. No. 5,159,748 to Doone et al., and U.S. Pat. No. 5,043,838 to Sakich.

Thus, there is a continuing need to provide improved electrical assemblies having a moisture activated barrier to reseal any locations where moisture may penetrate the assembly, particularly for composite insulator and surge arrester assemblies.

SUMMARY OF THE INVENTION

Accordingly, it is a primary objective of the present invention to provide an assembly having a coating between the core and the housing that reseals the housing upon penetration by moisture, thereby extending the service life of the assembly.

Another object of the invention is to provide a composite insulator assembly having a moisture activated coating between the rod and the housing that reseals the housing upon penetration by moisture, thereby extending the service life of the composite insulator assembly.

A further objective of the present invention is to provide a surge arrester assembly having a moisture activated coating between the MOV blocks and the housing that reseals the housing upon penetration by moisture, thereby extending the service life of the surge arrester assembly.

The foregoing objects are attainable by providing an assembly provided having a core that has first and second ends and a housing. The housing has first and second ends and an internal passageway extending from the first housing end to the second housing end for receiving the core. A coating of an uncured moisture activated material is disposed between the housing and the core. The material cures upon reacting with moisture penetrating the housing to reseal the housing at a point of moisture penetration.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Figure 3:
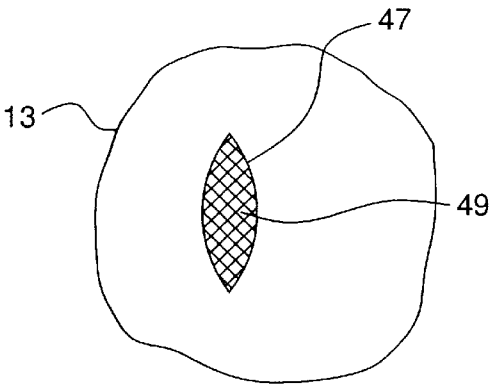
Figure 2:
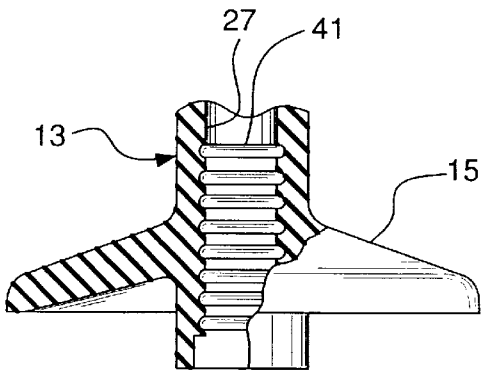
Figure 4:
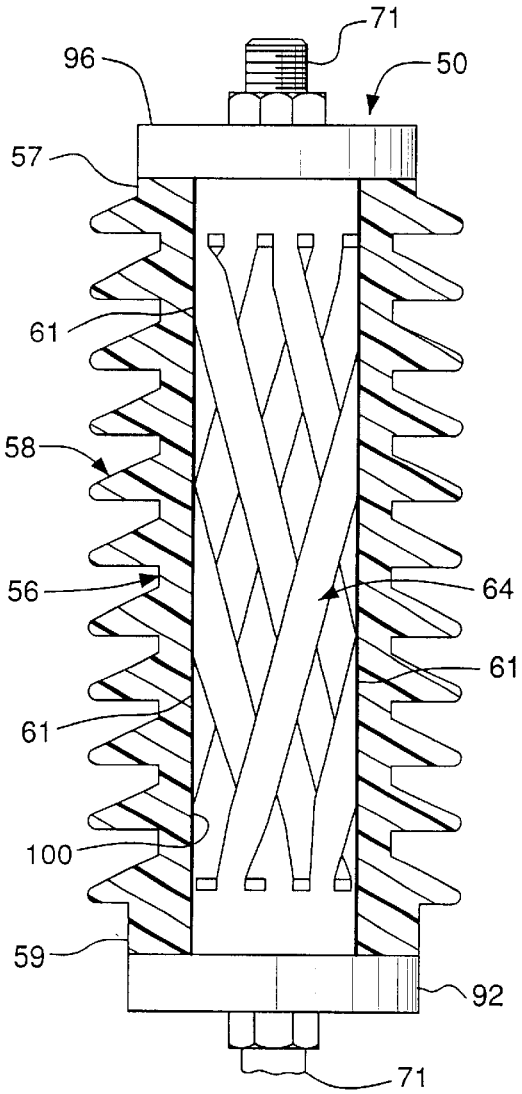
Figure 5:
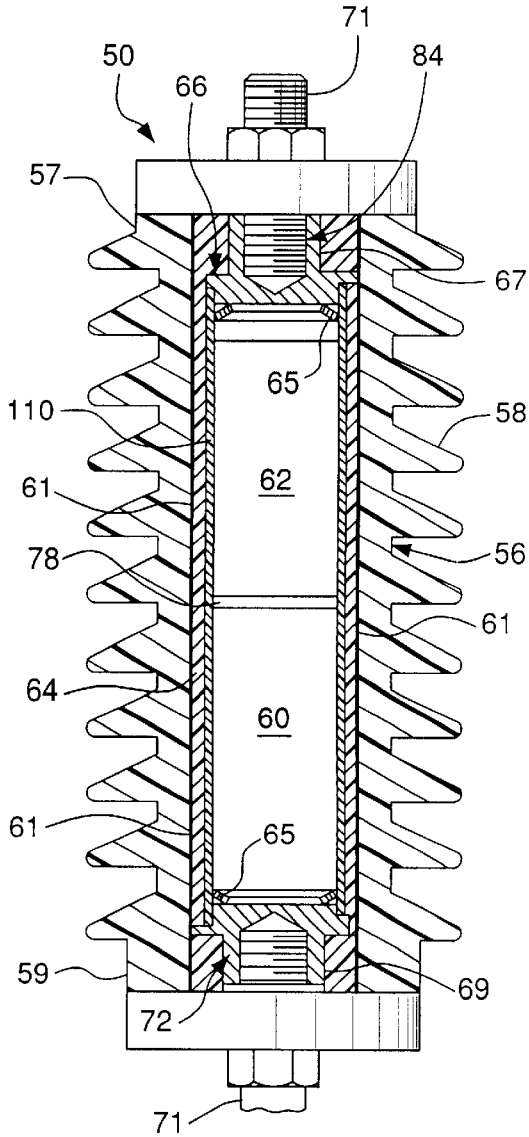

Referring now to the drawings that form a part of the original disclosure:

FIG. 1 is a side elevational view in partial cross-section of a composite insulator illustrating the moisture scavenging barrier between the housing and the rod;

FIG. 2 is a side elevational view in partial cross-section of a composite insulator weathershed housing illustrating the annular grooves along the internal passageway of the weathershed housing;

FIG. 3 is a close-up of a hole in a housing that has been resealed through the curing of the moisture activated material;

FIG. 4 is a side elevational view in section of a surge arrester illustrating the moisture scavenging barrier between the winding and the housing; and FIG. 5 is a side elevational view in section of the surge arrester of FIG. 4 illustrating the moisture scavenging barrier between the winding and the housing.

DETAILED DESCRIPTION OF THE INVENTION

As shown in FIGS. 1–5, the present invention relates to an assembly having a core 21 or 66 with first and second ends and a housing 13 or 56 having first and second ends. The housing has an internal passageway extending from the first housing end to the second housing end for receiving the core. A coating 17 or 61 of an uncured moisture activated material is disposed between the housing and the core. The material cures upon reacting with moisture penetrating the housing to reseal the housing at a point of moisture penetration, thereby extending the life of the assembly. Preferably, the material is a condensation-cured silicone compound. Preferably the condensation-cured silicone compound has an alkoxy system.

Composite Insulator Embodiment

In one embodiment of the present invention, the moisture activated barrier is disposed between a rod and a housing of a composite insulator, as shown in FIG. 1. Composite insulators are more fully described in U.S. Pat. No. 3,898,372 to Kalb, entitled "Insulator with Resin-Bonded Fiber Rod and Elastomeric Weathersheds, and Method of Making Same", which issued Aug. 5, 1975 and is hereby incorporated by reference in its entirety.

A composite insulator assembly 11, as shown in FIG. 1, has a rod 21 forming its core and having a first end 23 and a second end 25. A housing 13 has a first end 14 and a second end 16 and an internal passageway 27 extending from the first housing end to the second housing end for receiving the rod 21. A coating 17 of an uncured, moisture activated material is disposed between the housing 13 and the rod 21. The material cures upon reacting with any moisture penetrating the housing to reseal the housing at the point of moisture penetration.

The rod 21 has a first end 23 and a second end 25. Preferably, the rod is made of a fiberglass reinforced plastic. The rod 21 is received by the internal passageway 27 of the housing 13. End fittings 31 and 33 may be applied at each of the rod ends 21 and 23. The end fittings 31 and 33 may be attached to the rod ends in any manner, such as by crimping or potting. The rod 21 and the end fittings 31 and 33 support the entire tension load on the insulator 11.

A plurality of annular grooves 41, as shown in FIG. 2, extend along the internal passageway 27 of the housing 13. The grooves 41 keep the coating material in position and in contact with the rod 21 and the housing 13 under varying conditions of temperature and barometric pressure, and during movement and flexing of the composite insulator 11.

Depending on the demands of the situation in which the composite insulator is to be used, a longer composite insulator having several housing sections may be required to provide the mechanical and electrical properties required by the usage. A collar 35 connects first and second axially spaced housing sections 13 and 43 to provide a longer composite insulator 11. As many housing sections as needed may be connected by collars 35 to obtain a composite insulator 11 of the required length.

Preferably, the housing has a plurality of integral weathersheds 15. The primary function of the weathersheds is to protect the rod 21 against the elements and to provide the required creepage distance. Preferably, the weathersheds are made of a polymer.

The housing ends may be directly received by the end fittings. Alternatively, as shown in FIG. 1, corona stress rings 37 and 39 may be used to connect the housing ends 14 and 16 to the end fittings 31 and 33. The end fitting is inserted in one side of the opening extending through the corona stress ring; and the housing end is inserted in the opposite side of the opening. A fastener 45 is tightened to clamp the corona stress rings 37 and 39 onto the housing ends and the end fittings inserted therein.

A coating 17 of an uncured, moisture-activated material is applied between the rod 21 and the housing 13 by any suitable manner such that the entirely of the internal passageway is coated with the material. Preferably, the coating 17 is disposed along the internal passageway 27 of the housing 13 prior to or during the insertion of the rod 21. Preferably, the coating material is a condensation-cured silicone compound. Preferably the condensation-cured silicone compound has an alkoxy system. Preferably the material has a high dielectric strength of at least 100 V/mm.

When moisture penetrates the housing 13 or the end fittings 31 and 33 of the composite insulator 11, the uncured, moisture-activated material of the coating 17 reacts with the penetrating moisture. The material cross-links in the presence of the moisture, thereby bonding with the moisture to prevent the moisture from contacting the rod. This reaction ties up the moisture and reseals the housing or the end fittings at the location of the moisture breach, thereby extending the service life of the composite insulator. When damage to the insulator, such as a hole 47 as shown in FIG. 3, allows moisture to penetrate into the housing 13, the material of the coating 17 reacts with the penetrating moisture to form a rubber-like substance 49 that adheres to the housing 13 and to the rod 21. This rubber-like substance 49 seals the hole 47 in the housing 13 and prevents further moisture from penetrating at that location. Moisture is the limiting reagent in the reaction, therefore only the coating material in contact with the moisture reacts. The remaining material of the coating 17 remains uncured.

Surge Arrester Embodiment

In another embodiment of the present invention, the moisture activated barrier is disposed between a fiberglass wrapped MOV block assembly 66 and the housing 56 of a surge arrester 50, as shown in FIGS. 4 and 5. The surge arrester is more fully described in U.S. Pat. No. 5,043,838 to Sakich, entitled "Modular Electrical Assemblies with Pressure Relief", which issued Aug. 27, 1991 and is hereby incorporated by reference in its entirety.

A surge arrester 50, as shown in FIGS. 4 and 5, has at least one metal oxide varistor (MOV) block 60. A housing 56 has a first end 57 and a second end 59. An internal passageway 100 extends from the first housing end 57 to the second housing end 59 for receiving the metal oxide block assembly 66. Typically, an MOV block 60 has a non-conductive layer 64 wrapped around the MOV block. Preferably, the MOV blocks are metal oxide blocks wrapped in a fiberglass composite to form an MOV block assembly constituting the core of the surge arrester. The MOV block assembly 66 typically includes a pair of end terminals 72 and 84, at least one MOV block axially spaced between the end terminals to form an MOV block stack, at least one compression spring at an end of the MOV block stack, a plastic film barrier 110 laterally surrounding the MOV blocks and end terminals, and a non-conductive layer 64 wrapped around the plastic film barrier. The primary function of the non-conductive layer 64 is to mechanically support the MOV block assembly 66. If more than one MOV block is used, the MOV blocks 60 and 62 are axially spaced between end terminals 72 and 84; and a contact disc 78 separates adjacent MOV blocks. A coating 61 of an uncured, moisture activated material is dispersed between the MOV block assembly and the housing 56. The material cures upon reacting with moisture that has penetrated the housing to reseal the housing 56 or end terminals 72 and 84 at a point of moisture penetration.

The voltage rating of the surge arrester may be enlarged by increasing the number of MOV blocks contained within the housing, as shown in FIG. 5. Generally, the MOV blocks 60 and 62 are cylindrical components axially spaced within the MOV block assembly 66.

The MOV block assembly 66 has a first end 67 and a second end 69. To assemble the surge arrester 50, the MOV block assembly 66 is inserted within the internal passageway 100 of the housing 56. With the MOV block assembly filly inserted into the housing 56, the arrester end plates 92 and 96 are attached to corresponding module assembly end terminals 72 and 84, respectively. Typically, end bolts 71 are then tightened through end plates 92 and 96 and into module end terminals 72 and 84.

Depending on the demands of the situation in which the surge arrester is to be used, a longer surge arrester having several housing sections may be required to provide the mechanical and electrical properties required by the usage. A collar, as described and shown with regard to the composite insulator in FIG. 1, connects first and second axially spaced housing sections (not shown) to provide a longer surge arrester. As many housing sections as needed may be connected by collars to obtain a surge arrester of the required length. A surge arrester that is formed as a module and that my be selectively coupled together to vary the overall electrical rating of the device is described in more detail in U.S. Pat. No. 4,899,248 to Raudabaugh, entitled "Modular Electrical Assemblies with Plastic Film Barriers", which issued Feb. 6, 1990 and is hereby incorporated by reference in its entirety.

Preferably, the housing 56 has a plurality of integral weathersheds 58. The primary function of the weathersheds 58 is to protect the MOV blocks 60 and 62 against the elements and to provide the required electrical leakage distance. Preferably, the weathersheds are made of an elastomeric polymer.

A coating of an uncured, moisture-activate material is applied between the MOV block assembly 66 and the housing 56. Preferably, the coating 61 is disposed along the internal passageway 100 of the housing 56 prior to insertion of the MOV blocks 60 and 62. Preferably, the material is a condensation-cured silicone compound. Preferably, the condensation-cured silicone compound has an alkoxy system. Preferably, the material has a high dielectric strength of a least 100 V/mm.

When moisture penetrates the housing 56 or the end terminals 72 and 84 of the surge arrester 50, the uncured, moisture-activated material of the coating 61 reacts with the penetrating moisture. The material cross-links in the presence of the moisture, thereby bonding with the moisture to prevent the moisture from contacting the rod. This reaction ties up the moisture and reseals the housing or the end terminals at the location of the moisture breach, thereby extending the service life of the surge arrester. When damage to the surge arrester, such as a hole 47 as shown in FIG. 3, allows moisture to penetrate into the housing 56, the material of the coating 17 reacts with the penetrating moisture to form a rubber-like substance 49 that adheres to the housing 56 and to the MOV block assembly 66. This rubber-like substance 49 seals the hole 47 in the housing 56 and prevents further moisture from penetrating at that location. Moisture is the limiting reagent in the reaction, therefore only the coating material in contact with the moisture reacts. The remaining material of the coating remains uncured.

While advantageous embodiments have been chosen to illustrate the invention, it will be understood by those skilled in the art that various changes and modifications may be made therein without departing from the scope of the invention as defined in the appended claims.

What is claimed is:

1. An assembly, comprising:

a core having first and second ends;

a housing having first and second ends, said housing having an internal passageway extending from said first housing end to said second housing end for receiving said core; and a coating between said housing and said core of an uncured moisture activated material that cures upon reacting with moisture penetrating said housing to reseal said housing at a point of moisture penetration.

2. The assembly of claim 1, wherein said material is a condensation-cured silicone compound.

3. The assembly of claim 2, wherein said condensation-cured silicone compound has an alkoxy system.

4. The assembly of claim 1, wherein first and second end fittings are fastened to said first and second housing ends, respectively.

5. The assembly of claim 4, wherein the point of moisture penetration is in said housing between said first and second end fittings.

6. The assembly of claim 1, wherein said core is an insulator rod having first and second ends.

7. The assembly of claim 1, wherein said core is a metal oxide varistor block assembly.

8. The assembly of claim 1, wherein said housing has a plurality of integral weathersheds.

9. The assembly of claim 8, wherein said weathersheds are made of a polymer compound.

10. The assembly of claim 1, wherein said housing comprises first and second axially spaced sections, each of said sections having a plurality of integral weathersheds, said sections being connected by a collar.

11. The assembly of claim 10, wherein said weathersheds are made of a polymer compound.

12. The assembly of claim 1, wherein said material has a high dielectric strength.

13. The assembly of claim 1, wherein said material has a dielectric strength of at least 100 V/mm.

14. An insulator assembly, comprising:

a rod having first and second ends;

a housing having first and second ends, said housing having an internal passageway extending from said first housing end to said second housing end for receiving said rod; and a coating between said housing and said rod of an uncured, moisture activated material that cures upon reacting with moisture penetrating said housing to reseal said housing at a point of moisture penetration.

15. The insulator assembly of claim 14, wherein said material is a condensation-cured silicone compound.

16. The insulator assembly of claim 15, wherein said condensation-cured silicone compound has an alkoxy system.

17. The assembly of claim 14, wherein a plurality of annular grooves are formed along the internal passageway of the housing for receiving said coating.

18. The assembly of claim 14, wherein first and second end fittings are fastened to said first and second rod ends, respectively.

19. The insulator assembly of claim 18, wherein the point of moisture penetration is in said housing between said first and second end fittings.

20. The insulator assembly of claim 14, wherein said housing has a plurality of integral weathersheds.

21. The insulator assembly of claim 20, wherein said weathersheds are made of a polymer.

22. The insulator assembly of claim 14, wherein said housing comprises first and second axially spaced sections, each of said sections having a plurality of integral weathersheds, said sections being connected by a collar.

23. The insulator assembly of claim 22, wherein said weathersheds are made of a polymer compound.

24. The insulator assembly of claim 14, wherein a corona stress ring is positioned at each said housing end, said corona stress rings receiving said housing and said first or second end fitting, respectively.

25. The insulator assembly of claim 14, wherein said rod is a fiberglass reinforced plastic rod.

26. The insulator assembly of claim 14, wherein said material has a high dielectric strength.

27. The insulator assembly of claim 14, wherein said material has a dielectric strength of at least 100 V/mm.

28. A surge arrester assembly comprising:

at least one metal oxide varistor block;

a housing having first and second ends, said housing having an internal passageway extending from said first housing end to said second housing end for receiving said at least one metal oxide block;

a non-conductive layer wrapped around said at least one metal oxide block; and a coating between said housing and said non-conductive layer of an uncured, moisture activated material that cures upon reacting with moisture penetrating said housing to reseal said housing at a point of moisture penetration.

29. The arrester assembly of claim 28, wherein said material is a condensation-cured silicone compound.

30. The arrester assembly of claim 29, wherein said condensation-cured silicone compound has an alkoxy system.

31. The arrester assembly of claim 28, wherein first and second end terminals are attached to respective ends of said at least one metal oxide block.

32. The arrester assembly of claim 31, wherein the point of moisture penetration is in said housing between said first and second end terminals.

33. The arrester assembly of claim 28, wherein said housing has a plurality of integral weathersheds.

34. The arrester assembly of claim 33, wherein said weathersheds are made of a polymer compound.

35. The arrester assembly of claim 28, wherein said housing comprises first and second axially spaced sections, each of said sections having a plurality of integral weathersheds, said sections being connected by a collar.

36. The arrester assembly of claim 35, wherein said weathersheds are made of a polymer compound.

37. The arrester assembly of claim 28, wherein said nonconductive layer is made of a fiberglass composite.

38. The arrester assembly of claim 28, wherein said material has a high dielectric strength.

39. The arrester assembly of claim 28, wherein said material has a dielectric strength of at least 100 V/mm.

40. A method of making an electrical assembly, comprising coating one of a core and an internal passageway of a housing with an uncured moisture activated material;

inserting the core in the internal passageway of the housing; and sealing the housing with first and second end fittings attached at first and second housing ends, respectively.

41. A method of making an electrical assembly according to claim 40, further comprising installing the electrical assembly in an electrical line;

penetrating the housing with moisture at a point of moisture penetration; and resealing the housing at the point of moisture penetration by curing material to prevent further penetration of moisture.

* * * * *